US010219644B2

(12) United States Patent
Feeley et al.

(10) Patent No.: US 10,219,644 B2
(45) Date of Patent: Mar. 5, 2019

(54) MAT FOR STANDING WITH RAISED FEATURES

(71) Applicants: Ryan Feeley, Cupertino, CA (US); Christopher Perkins, Cupertino, CA (US); Isaac Borowiec, Cupertino, CA (US)

(72) Inventors: Ryan Feeley, Cupertino, CA (US); Christopher Perkins, Cupertino, CA (US); Isaac Borowiec, Cupertino, CA (US)

( * ) Notice: Subject to any disclaimer, the term of this patent is extended or adjusted under 35 U.S.C. 154(b) by 141 days.

(21) Appl. No.: 14/956,368

(22) Filed: Dec. 1, 2015

(65) Prior Publication Data

US 2016/0174745 A1 Jun. 23, 2016

Related U.S. Application Data

(60) Provisional application No. 62/096,489, filed on Dec. 23, 2014.

(51) Int. Cl.
*A47G 27/02* (2006.01)

(52) U.S. Cl.
CPC ..... *A47G 27/0231* (2013.01)

(58) Field of Classification Search
CPC ..... A47G 27/0231
USPC ..... 428/80
See application file for complete search history.

(56) References Cited

U.S. PATENT DOCUMENTS 611,251 A 9/1898 Herhold
D114,231 S 4/1939 Otis
D191,901 S 12/1961 Breneman et al.
3,100,483 A * 8/1963 Altmeyer ..... A61H 7/001 601/28
3,885,555 A 5/1975 Nobbs
4,329,981 A * 5/1982 Dungl ..... A61H 7/001 601/28
4,772,014 A * 9/1988 Rebman ..... A63B 69/0035 482/148
5,108,094 A 4/1992 Quinn et al.
5,116,014 A 5/1992 Slavens et al.
D330,988 S 11/1992 Robbins, III
(Continued)

FOREIGN PATENT DOCUMENTS

WO WO 2012/107740 A1 † 8/2012
WO 2016106356 6/2016

OTHER PUBLICATIONS

International Search Report dated Feb. 26, 2016, for International Patent Application No. PCT/US15/67456, 4 pages.
(Continued)

*Primary Examiner* — Brent T O'Hern
(74) *Attorney, Agent, or Firm* — Kilpatrick Townsend & Stockton LLP

(57) ABSTRACT

A mat includes a mat body defining an upper surface dimensioned for a user to stand on the upper surface. The upper surface is non-planar and includes at least one terrain feature defining the non-planarity. The terrain feature has a size that is on the order of magnitude of the size of the user's foot. Presenting this surface to the user may help remind him or her to move his or her feet to thereby adopt multiple poses, thereby preventing the user from maintaining any single pose for a fatigue-inducing duration.

19 Claims, 5 Drawing Sheets

(56) References Cited

U.S. PATENT DOCUMENTS

| | | | | |
|---|---|---|---|---|
| D347,718 | S | 6/1994 | Craft et al. | |
| D446,354 | S | 8/2001 | Jusinski | |
| D497,277 | S | 10/2004 | Ruhl et al. | |
| D520,097 | S | 5/2006 | Walch | |
| D655,118 | S | 3/2012 | Zabel | |
| 8,677,532 | B2 | 3/2014 | Legare | |
| D796,227 | S * | 9/2017 | MacNeil | D6/583 |
| 2007/0078020 | A1 * | 4/2007 | Jong | A63B 69/3673 473/160 |
| 2007/0110950 | A1 | 5/2007 | Yang | |
| 2008/0149122 | A1 * | 6/2008 | Lovely | A45D 29/18 132/76.5 |
| 2009/0139017 | A1 † | 6/2009 | Anderson | |
| 2010/0231400 | A1 | 9/2010 | Von Mohr et al. | |
| 2012/0065033 | A1 * | 3/2012 | Moring, Jr. | A63B 21/00047 482/92 |
| 2013/0269112 | A1 * | 10/2013 | Legare | A47G 9/062 5/648 |
| 2015/0096597 | A1 | 4/2015 | Patel | |

OTHER PUBLICATIONS

Written Opinion dated Feb. 26, 2016 for International Patent Application No. PCT/US15/67456, 5 pages.

Matheson, "How Anti-Fatigue Mats Reduce Fatigue." Retrieved from the Internet on Feb. 9, 2016; Jun. 17, 2013; URL:<https://web.archive.org/web/20130617040513/http://www.mathesongas.com/industrialgas/pdfs/safety/matting.pdf>, 13 pages.

Ergodriven, "This Mat Makes Your Standing Desk Better." Retrieved from the Internet on Feb. 5, 2016; Sep. 19, 2016; URL: https://web.archive.org/web/20160116090559/http://ergodriven.com/topo/, 4 pages.

"Ergogo Standing Desk Mat by Ergogo Amazon.com", https://www.amazon.com/dp/B01 N97TYA3?psc=1, Nov. 22, 2016.

"Ergohead Standing Desk Mat by Ergohead. Amazon.com", https://www.amazon.com/dp/B01MUCCYW2/ref=psdc_9720393011_t4_BOOV3T09RC, Jan. 19, 2017.

"Topo by Ergodriven Amazon.com", https://www.amazon.com/dp/BOOV3T09RC?psc=1, Mar. 23, 2015.

"Topo Mini by Ergodriven. Amazon.com", https://www.amazon.com/dp/B01 N8YE3VI?psc=1, Feb. 13, 2017.

U.S. Appl. No. 29/547,204, "Notice of Allowance", dated Jul. 13, 2016, 9 pages.

U.S. Appl. No. 29/583,904, "Ex Parte Quayle Action", dated Oct. 5, 2017, 28 pages.

Matheson, "How Anti-Fatigue Mats Reduce Fatigue," which was published on the Internet and is believed to have been available since at least Jun. 17, 2013, and was retrieved from the Internet on Dec. 21, 2016; URL: http://www2.mathesongas.com/industrialgas/pdfs/safety/matting.pdf, 13 pages.†

* cited by examiner
† cited by third party

MAT FOR STANDING WITH RAISED FEATURES

CROSS-REFERENCES TO RELATED APPLICATIONS

This application claims priority to U.S. provisional Application Ser. No. 62/096,489, filed Dec. 23, 2014, entitled "CALCULATED TERRAIN MAT," the disclosure of which is hereby incorporated by reference in its entirety.

BACKGROUND

Field of the Invention

The invention is generally directed to ergonomic furniture, and more specifically, to a mat on which a user stands, such as while using a standing desk.

Description of Related Art

Soft, so-called "anti-fatigue" mats are known. One example is the Cumulus Pro anti-fatigue mat, manufactured by Imprint Comfort Mats, available at http://imprint-mats.com/content/cumuluspro. Known mats generally provide a soft surface on which a user stands, to alleviate fatigue (as compared to standing on a relatively hard floor) while standing for extended periods of time. The exposed standing surface of all such mats is flat and devoid of topographical features.

SUMMARY

A mat includes a mat body defining an upper surface dimensioned for a user to stand on the upper surface. The upper surface is non-planar and includes at least one terrain feature defining the non-planarity. The terrain feature has a size that is on the order of magnitude of the size of the user's foot.

Presenting this surface to the user may help remind him or her to move his or her feet to thereby adopt multiple poses, thereby preventing the user from maintaining any single pose for a fatigue-inducing duration.

The terrain feature may be a protrusion comparable in size to the foot. The protrusion may have a shape that is complementary to the shape of the arch of the user's foot.

Additionally or alternatively, the terrain feature may be at least one raised rail.

Two lateral rails may be provided at lateral sides of the mat body, configured for the user to adopt a widened stance by placing one foot on each of the lateral rails. The height of the lateral rails may be such that the torso of the user does not significantly lower when the user moves from a neutral stance, standing medial to the rails, to the widened stance.

Additionally or alternatively, an anterior rail may be provided, configured for the user's toes to wrap around the anterior rail.

Additionally or alternatively, one or more lateral anterior corner rails may be provided, configured for the user's toes to wrap around the corner rails. The lateral anterior corner rails may connect the lateral rails to the anterior rail, and may have a greater height than the lateral rails and than the anterior rail.

Additionally or alternatively, a posterior rail may be provided. The posterior rail may have a ramped surface connecting the posterior rail to a remainder of the mat body. An anteroposterior length of the posterior rail may be comparable to the length of a foot. Additionally or alternatively, the posterior rail may have a ramped surface configured for the user's toes to rest on the apex of the posterior rail, while the user's heels rest of the floor.

The mat may further include a notch in the mat body configured to be engaged by the foot such that user can move the mat with the foot.

The mat may further include a substantially planar portion. The planar portion and the terrain feature may cooperate with one another to define the upper surface such that the upper surface as a whole is non-planar. The planar portion may be substantially horizontal, or may be angled or crowned with respect to horizontal, such as at an angle of approximately 0°-2°.

BRIEF DESCRIPTION OF THE DRAWINGS

Exemplary embodiments will be described in more detail with reference to the accompanying drawings, in which.

DETAILED DESCRIPTION

Figure 1:
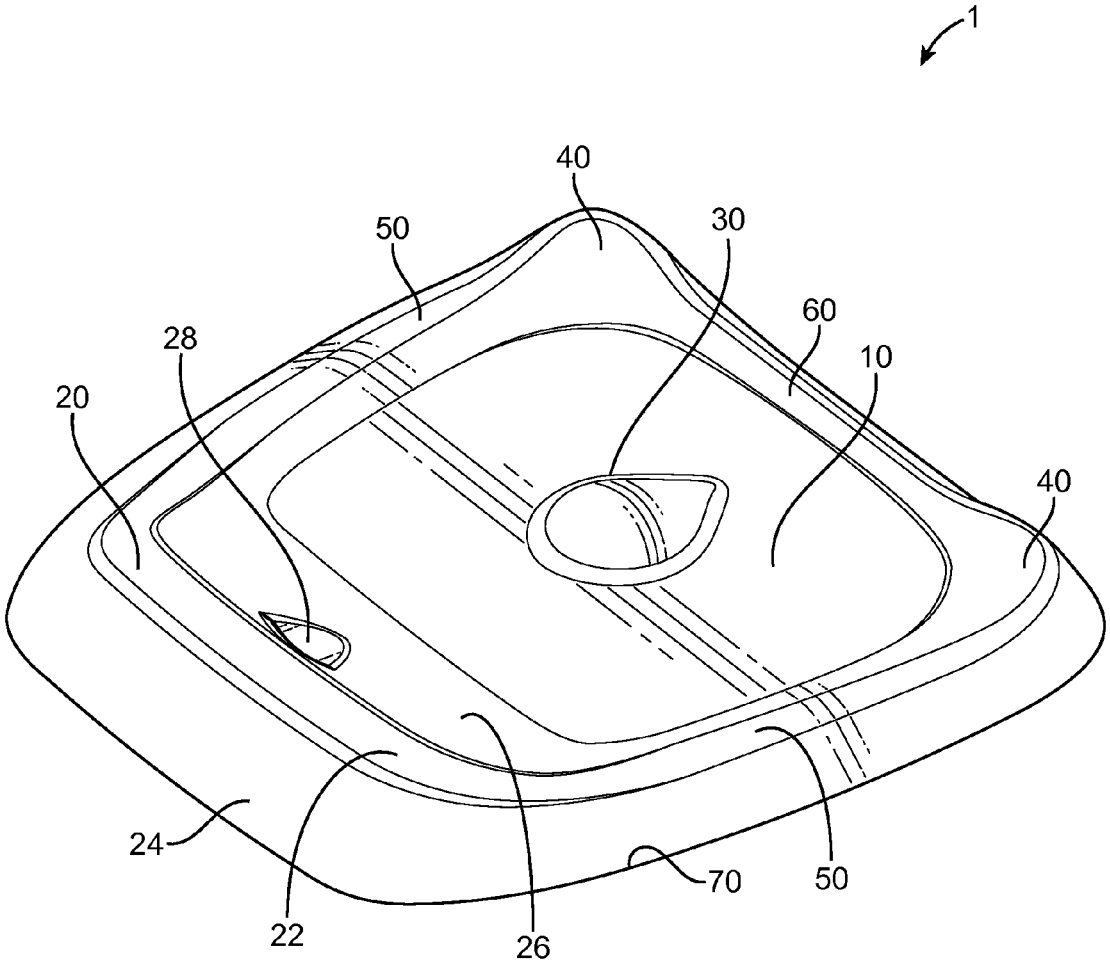
FIG. 1 is a perspective view of an exemplary mat.

The embodiments described herein facilitate myriad standing positions and increase movement of otherwise stationary standing users by providing a variety of topographical shapes and features in the mat surface.

The embodiments described herein are considered useful for both barefoot and shoed use.

The embodiments described herein allow, facilitate, and motivate a user to occupy a variety of positions when standing. The inspiration for the embodiments described herein stems from the same general goal as that of some of the embodiments described in the Applicants' co-pending non-provisional application Ser. No. 14/732,651, filed Jun. 5, 2015, titled "Standing Platform" (hereinafter "the '651 application"), the disclosure of which is hereby incorporated by reference. Namely, if a user is standing for a significant period of time, frequent changes in pose and/or stance will alleviate fatigue and ultimately lead to health benefits, as compared to standing still. However, many of the embodiments described in the '651 application use dynamic movement to physically prompt or cue a user to move, or in some extreme examples, the apparatus physically moves the user between poses or stances. The embodiments described herein differ from the dynamic prompting or cueing of the '651 application in that the embodiments described herein have no moving parts, but instead contain terrain features or surface variations that provide varied shapes across three-dimensional space, but are constant over time. Thus, in the same way that many embodiments of the '651 application can be said to dynamically prompt or cue a user to vary his or her position, the embodiments described herein can be said to statically remind, invite, facilitate, motivate, or encourage the user to vary his or her position, without the discrete time intervals used for the prompts or cues of many embodiments of the '651 application.

In general, the embodiments described herein provide a mat dimensioned for a user to stand thereon. The top, exposed surface of the mat on which the user will stand comprises several surface variations or terrain features, whose size and/or slope is comparable to the size and/or slope of a user's foot, such as on the same order of magnitude as the size and/or slope of a user's foot. In other words, prior art mats may include "pebbling" (i.e. surface roughness), but the size of the features that define this roughness is much smaller than a typical human foot, and these features do not provide varied terrain or surfaces for the user to stand on in any appreciable way. Prior art mats may also include beveled edges, but their size and the location at the extreme margins of the mat do not allow for the user to stand on varied terrain or surfaces in any appreciable way.

The shape of the outline profile is designed to reflect the actual positions users take when standing, data for which was gathered with long-duration video of users at standing desks. The topographic shapes and features provide for support of the user's weight in a variety of positions, and encourage the user to occupy myriad positions throughout the course of use. The bottom surface is designed to allow easy repositioning of the mat by not unduly resisting movement through friction.

One goal of the embodiments described herein is to provide the benefits of the natural terrain variation and movement included in a walk through undeveloped terrain to the relatively stationary users of standing desks in office environments and other stationary environments. The increased movement and load variation facilitated by the topographical features of the mat improve blood flow, strengthen balance muscles, and increase productivity.

One presently preferred example of the size and shape of a mat 1 is illustrated in the Figures. The specific terrain features shown, while presently preferred for various reasons, are not intended to be limiting. Any topographical features that are comparable in size to a user's foot are within the scope of the invention. Turning now to the Figures, in one specific exemplary embodiment, the top surface of the mat 1 includes a neutral standing area 10, a back ramp 20, a central protrusion 30, front corner supports 40, side rails 50, and a front rail 60.

The neutral standing area 10 is predominantly flat, with a slight crown (e.g., at an angle of approximately 0°-2°) to further promote engagement of users' balance faculties. Since the crowned area is not completely horizontal, it will force the user to engage muscles associated with balancing, thereby strengthening the muscles and improving blood flow.

The prominent back ramp 20 provides an angled supporting surface for stances split across the body's frontal plane.

Figure 5A:
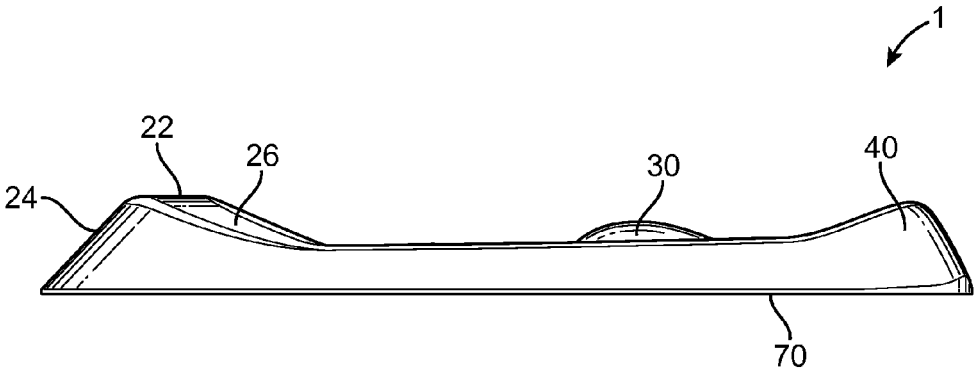
FIGS. 5A and 5B are a right side and a left side elevational view of the mat, respectively.
Figure 5B:
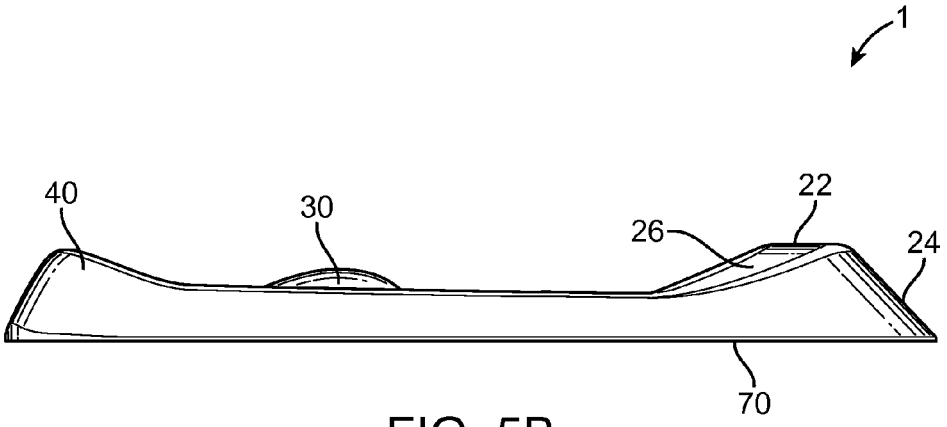

Furthermore, the elevated top surface 22 of the ramp 20 provides a platform for "calf pump" exercises in which flexion of the calf muscles promotes healthy bloodflow. The user may place the balls of the feet at the apex 22 of the ramp 20 and extend the foot with the heel stretched down and back from the ball of the foot (down and to the left in FIGS. 1 and 5), providing increased range of motion over calf pump exercises that begin with the foot flat on a horizontal floor. The user may then stand up on his or her toes to activate the calf muscles. Calf pumps have been shown to increase blood flow by mimicking the motion taken while walking, and provide innumerable health benefits. The present inventors have reason to believe that the increased range of motion permitted by extending the heel below the ball of the foot leads to even further increased blood flow and greater health benefits.

The rearmost angled surface 24 of the ramp 20 provides a surface to place the foot upon for stretching the posterior leg muscles (calf and/or hamstring) during use. A user can stand with one foot on the frontmost angled surface 26 of the ramp 20, the other foot on the rearmost angled surface 24, and achieve an effective stretch of the calf muscle of the foot on the rear surface 24. Similarly, the user can stand with both feet on the rearmost angled surface 24 and stretch the calves of both legs simultaneously. The inventors find calf stretches to be beneficial both to compensate for joint range of motion lost when frequently wearing shoes with a "drop" (having a thicker heel than the forefoot area) and also help collapse the veins in the calf by elongating the muscle fibers. Occasional collapse of these veins helps prevent blood pooling. When placing both feet on the rear surface 24, a simple bend-at-the-waist hamstring stretch can be achieved without bending over as far (users may be unlikely to bend completely over in an office environment). The iliotibial (IT) band can also be stretched using the ramp 20.

The central protrusion 30, which in the illustrated embodiment has a "teardrop" shape in plan view (with other shapes, such as a simple hemisphere, also considered), provides arch support for the user's foot when used. Furthermore, the central protrusion feature 30 allows for "ankle rolls" (stretching and mobility exercises of the ankle joint) when the forefoot is placed on or near the apex of the protrusion 30. The size and slope of the central protrusion 30 is such that it encourages both placing the arches of one or both feet on the sloped sides, and placing the ball of a single foot on the apex.

The front corner supports 40 provide an angled surface with midfoot arch support when the forefoot is placed on or near the apex of the feature 40 for supporting a split stance across the body's frontal or medial planes. The profile of the ridgeline across the front corner supports 40 and front rail 60 provides for toe gripping or clutching during use as well.

The side rails 50 provide an elevated surface for a split stance across the body's medial plane, reducing the drop in height of the user's torso and hands when occupying a split stance, allowing for maintenance of an ergonomically optimal keyboard and monitor position. Without a raised feature such as this, the geometry of the body would result in lowered torso height when a split stance is occupied, thus dropping the hands relative to the keyboard and dropping the eyes relative to the monitor. Furthermore, the side rails 50 provide another elevated surface for ankle mobility and stretching movements.

The front rail 60 provides a protrusion for toe clinching or gripping, especially when barefoot, and support for a split stance about the body's frontal plane.

The bottom surface 70 eschews the high friction "anti-slip" surfaces common in the prior art for a mindfully designed surface with a coefficient of friction that allows for simple repositioning by the user with only a foot. This is considered particularly useful for users with sit/stand convertible desks, who will likely choose to slide the mat 1 out of the way underneath a chair or desk when adopting a seated posture. Note that many prior art mats known to the inventors are intended for permanent use on slick kitchen floors and have been purposely designed with high-friction bottom surfaces so as not to slip around during use. The presently preferred embodiments, on the other hand, can slide easily even on carpeted office floors thanks to the low-friction bottom surface 70.

Sliding the mat 1 out of the way is further facilitated by the toe grip notch 28, which allows a user, particularly when barefoot, to grip the mat 1 with the toes and slide the mat 1 out of the way with a single foot, without bending over to manually grab and reposition the mat 1. The toe grip notch 28 can also be engaged or hooked with the heel or forefoot to slide the mat 1.

Figure 2:
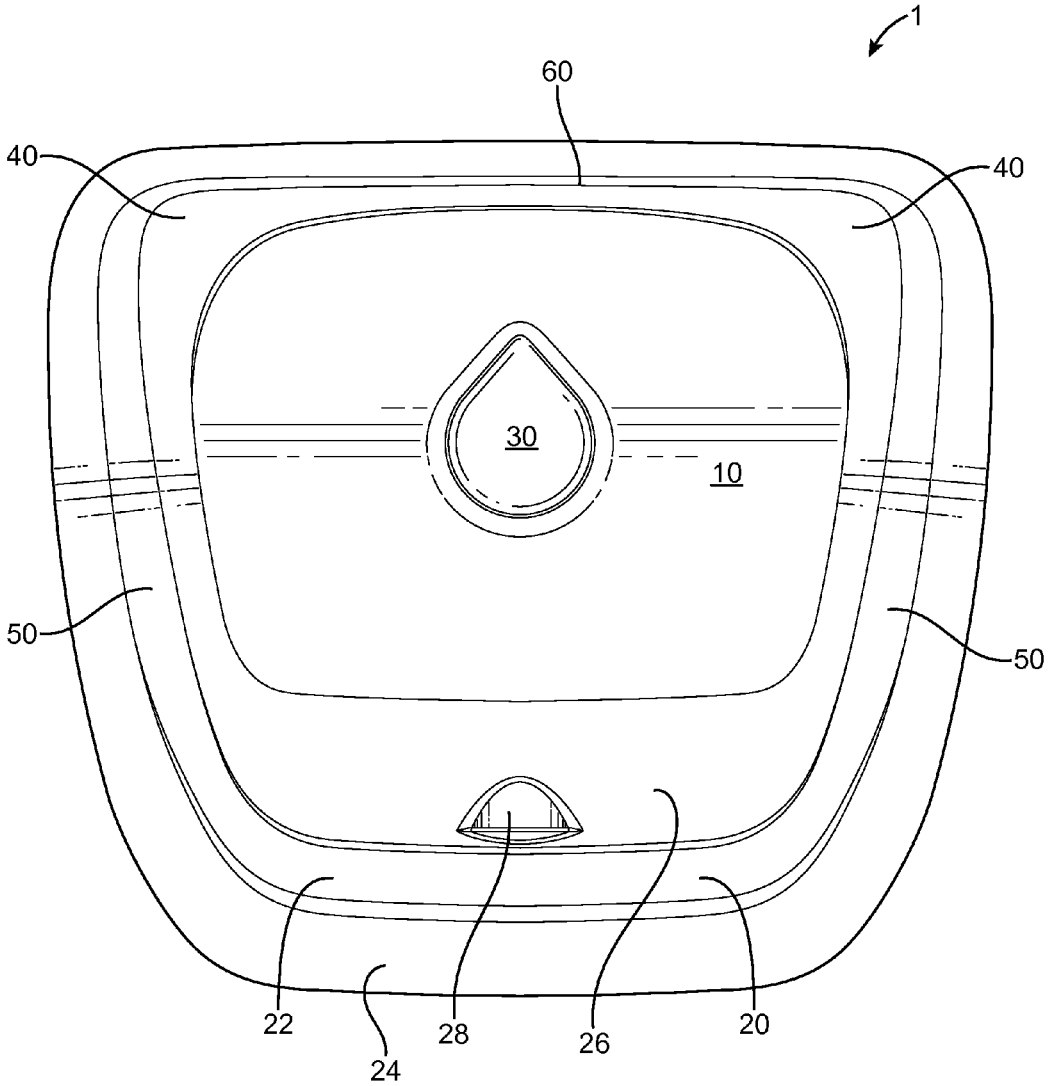
FIG. 2 is a plan view of the mat.
Figure 3:
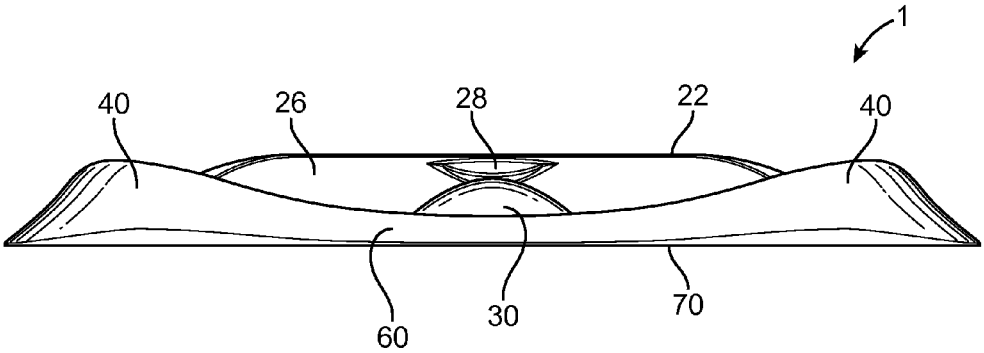
FIG. 3 is a front elevational view of the mat.
Figure 4:
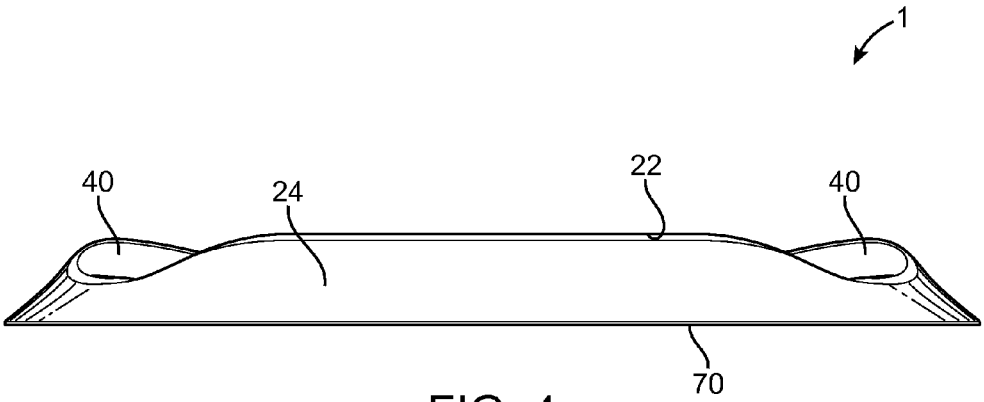
FIG. 4 is a rear elevational view of the mat.
Figure 6:
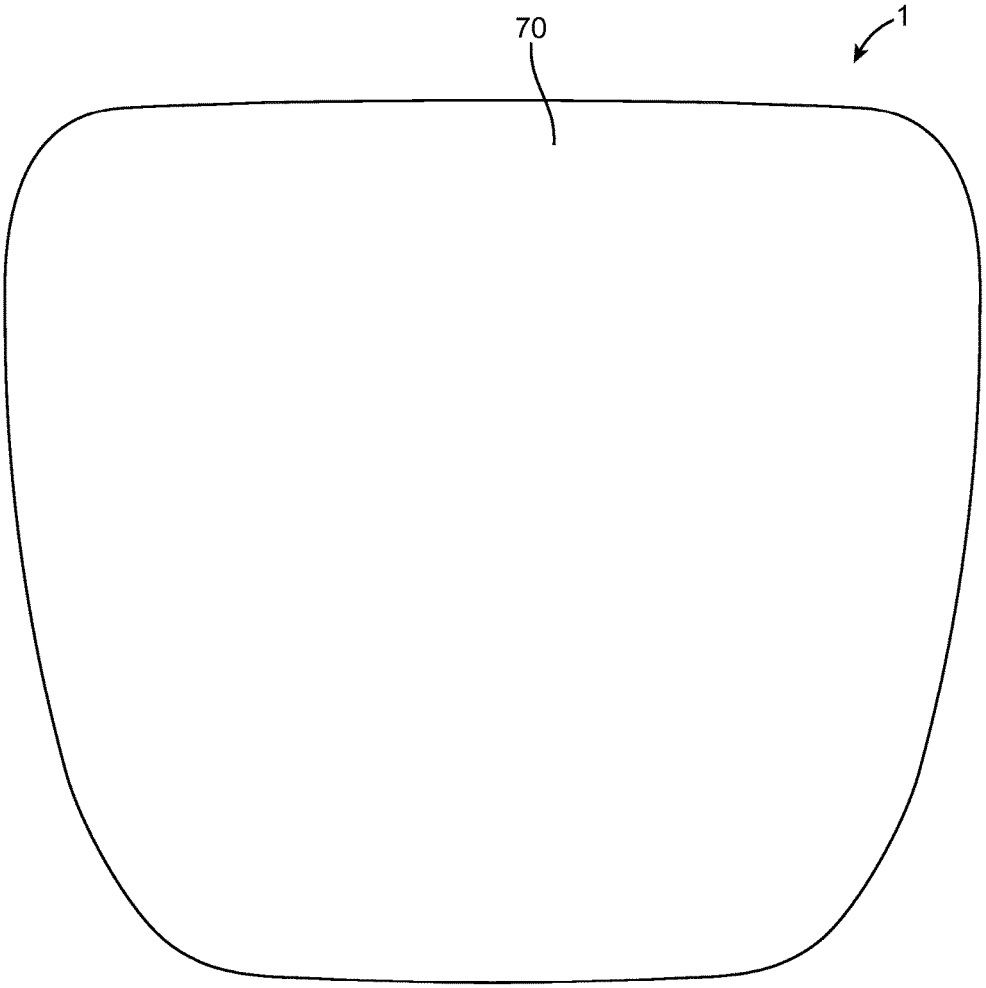
FIG. 6 is a bottom view of the mat.

Referring to FIGS. 2 and 6, the shape of the footprint of the mat 1 can be seen. This footprint (not square or rectangular like the prior art) tapers with the natural alignment of the outer edges of users' feet when standing (wider in the front, narrower in the back). It should be appreciated, as seen in FIG. 2, that the width of the rear rail of the mat 1 is narrower than the width of the front rail. Furthermore, the decreased width (laterally) and increased depth (anteroposteriorly), relative to the sizing common in the prior art, is designed to support the user in the areas of their workspace they actually use, or ergonomically should be compelled to use.

Exemplary, non-limiting dimensions of a presently preferred embodiment are as follows:

Overall dimensions: 26.5" front-to-back, 29" side-to-side, 2.7" tall at the highest point.

Surface 10 (which has a slight crown) has an average height relative to the bottom surface 70 of approximately 0.75".

Surface 22 is the highest point at 2.7" from the bottom surface 70.

The apex of surface 30 is 2.1" from the bottom surface 70.

Surface 40 is 2.4" from the bottom surface 70.

Surface 50 also has a slight crown, but has an average height of approximately 1.5" from the bottom surface 70.

Surface 60 is 0.9" from the bottom surface 70.

Protrusion 30 has an approximate length of 6" and an approximate width of 5".

These dimensions are exemplary only and are included herein as approximate guidelines for what is meant by the size and/or slope of the surface variations or terrain features being comparable to the size and/or slope of a user's foot.

The inventors have also contemplated a smaller version of the mat 1, which may be useful for users with particularly small workstations, users that are shorter in stature and therefore may prefer to adopt narrower split stances in both the anteroposterior and lateral directions, and/or children. A presently preferred embodiment of the small version is scaled down to approximately 80% of the length and approximately 80% of the width, while the heights of the various terrain features may remain the same. Alternatively, for certain workstation setups, the length and the width may advantageously be scaled differently relative to one another than in the illustrated embodiments.

As can be recognized, other shapes, features, and overall appearances may be used to achieve the desired functionality while allowing for variations in the way the mat will appear. It can be appreciated that such combinations of ornamental and functional design attributes can be embodied with differing aesthetics to enable differing overall appearances for the mat having the above-described features.

As will be understood by those skilled in the art, the present invention may be embodied in other specific forms without departing from the essential characteristics thereof. Many other embodiments are possible without departing from the essential characteristics thereof. Many other embodiments are possible without deviating from the spirit and scope of the invention. These other embodiments are intended to be included within the scope of the present invention, which is set forth in the following claims.

What is claimed is:

1. A mat, comprising:

a unitary, monolithic mat body defining an upper surface dimensioned for a user to stand on the upper surface, wherein the upper surface is non-planar and comprises one or more terrain features defining a non-planarity, wherein the terrain features have a size that is on an order of magnitude of a size of a foot of the user, and wherein the terrain features comprise an anterior rail and a lateral anterior corner rail at each front corner of the mat, wherein a height of the anterior corner rails is greater than a height of the anterior rail.

2. The mat of claim 1, wherein the one or more terrain features further comprise a protrusion comparable in size to the foot.

3. The mat of claim 2, wherein the protrusion comprises a shape that is complementary to a shape of an arch of the foot.

4. The mat of claim 1, wherein the one or more terrain features further comprise two rails at lateral sides of the mat body, configured for the user to adopt a widened stance by placing one foot on each of the rails.

5. The mat of claim 4, wherein a height of the rails is such that a height of a torso of the user does not significantly lower when the user moves from a neutral stance, standing medial to the rails, to the widened stance.

6. The mat of claim 1, wherein the terrain features further comprise an anterior rail configured for toes of the user to wrap around the apex of the anterior rail.

7. The mat of claim 6, wherein the lateral anterior corner rails are located at opposing ends of the anterior rails and are configured for toes of the user to wrap around each corner rail.

8. The mat of claim 4, wherein a height of the corner rails is greater than a height of the lateral rails.

9. The mat of claim 1, wherein the one or more terrain features further comprise a posterior rail.

10. The mat of claim 9, wherein the posterior rail comprises a ramped surface connecting the posterior rail to a remainder of the mat body, wherein an anteroposterior length of the rail is comparable to an anteroposterior length of the foot.

11. The mat of claim 9, wherein the posterior rail comprises a ramped surface configured for toes of the foot to rest on an apex of the posterior rail and a heel of the foot to be on a surface on which the mat rests.

12. The mat of claim 1, further comprising a notch in the mat body configured to be engaged by the foot such that user can move the mat with the foot.

13. The mat of claim 1, wherein the upper surface further comprises a substantially planar portion, wherein the substantially planar portion and the one or more terrain features cooperate with one another to define the upper surface such that the upper surface as a whole is non-planar.

14. The mat of claim 13, wherein the planar portion is substantially horizontal when the mat rests on a horizontal surface.

15. The mat of claim 13, wherein the planar portion is angled or crowned with respect to horizontal, when the mat rests on a horizontal surface.

16. The mat of claim 15, wherein the planar portion is angled or crowned at an angle of approximately 0°-2°.

17. A unitary, monolithic mat, comprising:

a top surface having a neutral standing area, wherein a perimeter of the neutral standing area includes a rear angled surface, raised side rails, and a raised front rail with corner supports, wherein the width of the rear angled surface is narrower than the width of the front rail, and wherein a central protrusion rises up from the neutral standing area; and a bottom surface having a coefficient of friction that allows for functional repositioning of the mat by a foot of a user.

18. The mat of claim 17, wherein each of the raised side rails are curved forming the perimeter, connecting the rear angled surface and the raised front rail.

19. The mat of claim 17, wherein the central protrusion has a teardrop shape.

* * * * *